US006059195A

United States Patent [19]

Adams et al.

[11] Patent Number: 6,059,195

[45] Date of Patent: May 9, 2000

[54] INTEGRATED APPLIANCE CONTROL SYSTEM

[75] Inventors: Donald J. Adams, Chagrin Falls; Robert D. Rothrock, Leroy, both of Ohio

[73] Assignee: Tridelta Industries, Inc., Mentor, Ohio

[21] Appl. No.: 09/012,697

[22] Filed: Jan. 23, 1998

[51] Int. Cl.[7] ..... F23N 1/08

[52] U.S. Cl. ..... 236/20 R; 236/21 B; 236/94; 431/50; 431/66

[58] Field of Search ..... 236/94, 20 R, 236/21 R, 21 B, 26 A; 431/24, 25, 26, 43, 44, 45, 46, 50, 66

[56] References Cited

U.S. PATENT DOCUMENTS

| | | | |
|---|---|---|---|
| 4,190,414 | 2/1980 | Elmy | 432/46 |
| 4,505,253 | 3/1985 | Mizuno et al. | 126/351 |
| 4,508,261 | 4/1985 | Blank | 236/20 |
| 4,522,333 | 6/1985 | Blau, Jr. et al. | 236/20 |
| 4,564,141 | 1/1986 | Montgomery et al. | 236/20 |
| 4,620,667 | 11/1986 | Vandermeyden et al. | 236/20 |
| 4,678,116 | 7/1987 | Krishnakumar et al. | 236/25 |
| 4,713,525 | 12/1987 | Eastep | 219/308 |
| 4,832,259 | 5/1989 | Vendermeyden | 236/20 |
| 4,834,284 | 5/1989 | Vandermeyden | 236/20 |
| 4,850,310 | 7/1989 | Wildgen | 122/483 |
| 4,863,372 | 9/1989 | Berlincourt | 431/66 |
| 4,891,004 | 1/1990 | Ballard et al. | 236/94 X |
| 4,934,925 | 6/1990 | Berlincourt | 431/67 |
| 5,020,721 | 6/1991 | Horne | 236/20 |
| 5,023,432 | 6/1991 | Boykin et al. | 219/497 |
| 5,053,978 | 10/1991 | Solomon | 364/550 |
| 5,056,712 | 10/1991 | Enck | 236/20 |
| 5,092,519 | 3/1992 | Staats | 236/21 |
| 5,197,664 | 3/1993 | Lynch | 236/94 X |
| 5,203,500 | 4/1993 | Horne, Sr. | 237/19 |
| 5,626,287 | 5/1997 | Krause et al. | 236/20 |
| 5,863,194 | 1/1999 | Kadah et al. | 431/24 |

FOREIGN PATENT DOCUMENTS 2132791 12/1982 United Kingdom .

OTHER PUBLICATIONS

Richard J. Babyak, *Appliance Manufacturer*, Whole–house, instantaneous water heater uses sophisticated control scheme to operate with variable energy input, Jul. 1997, pp. 27–28.

*Primary Examiner*—Harry B. Tanner
*Attorney, Agent, or Firm*—Arter & Hadden LLP

[57] ABSTRACT

A fully integrated electronic appliance controller for controlling the operation of a appliance (e.g., a gas-fired water heater or boiler). The controller includes an integrated intelligent control system; enhanced safety features including an igniter current proving circuit, a flame detection circuit, a safety limit string and an energy cut-out (ECO) control; an intelligent user interface including a display unit and a communications system; and an adaptive control feature. According to a preferred embodiment of the present invention, the controller is adapted to receive as many as four temperature probes (e.g., thermistors). The first probe senses the water temperature at the outlet of a water heater, the second probe senses the water temperature at the inlet of the water heater, the optional third probe senses the temperature at a first location in an associated remote water storage tank, and the optional fourth probe senses the temperature at a second location in the associated remote water storage tank.

42 Claims, 9 Drawing Sheets

INTEGRATED APPLIANCE CONTROL SYSTEM

FIELD OF INVENTION

The present invention relates generally to an appliance controller, and more particularly relates to an integrated electronic control system for controlling an appliance, such as a gas-fired water heating device.

BACKGROUND OF THE INVENTION

Prior art appliance control systems, such as those for gas-fired water heating appliances, have consisted of separate functional units, including a central control unit, a thermostat, high limit circuitry, safety circuitry, a user interface and a display unit. As a result, it has been difficult to provide a simple and effective self-testing diagnostics system for the entire control system, an informative display unit for displaying detailed operating information, a unified intelligent user interface, and enhanced safety features. Moreover, interfacing and coordinating operation of these separate functional units has been complex, inefficient and costly. Accordingly, there is a need for an integrated appliance control system that is easily adapted for use with a variety of different appliances, is simple to install, customize, operate and maintain, is inexpensive to manufacture, and provides enhanced safety features.

In connection with heating appliances in such fields as water heating, space heating, commercial cooking, and the like, there is often the need for the appliance control system to provide high limit or energy cut-out (ECO) controls, a safety limit string, an igniter current proving circuit, and a flame detection circuit.

ECO controls provide a backup or secondary thermostat function as required by various safety standards or regulations. Typically, ECO controls are of an electromechanical design, such as capillary fluid-filled tubes (which use the principle of fluid expansion to open a microswitch) or bimetallic thermoswitches using dissimilar metals (one of which deforms in the presence of heat) to provide switch contact openings and hence, interrupt power to the gas valve(s) upon reaching a maximum operating temperature.

Both capillary tube thermostats and bimetallic thermoswitch thermostats have significant drawbacks. In this regard, capillary tube thermostats have an inherently unsafe failure mode in that if the copper tube from the sensing bulb becomes fractured (due to fatigue from flexure or vibration), the fluid (upon expansion due to heat) will leak out and have the effect of "looking" like a continuous heat demand to the control.

Bi-metallic thermoswitches suitable for use in commercial hot water heating applications are typically encapsulated into a thermowell assembly. The thermoswitches add a significant cost premium to the control system, and have poor temperature tolerance around the fixed set point temperature (±3 deg. C., typ.). Moreover, applications requiring different high limit temperatures within the same family of appliance often results in the creation of non-standard parts with prohibitive cost and procurement lead times. Another drawback to thermoswitches is their cycle life rating. Generally, thermoswitches are only required to withstand 1000 full-load cycles. Similarly, the load-carrying capability of thermoswitches is limited by their physical size (e.g., 3½ amps).

Finally, both capillary tube thermostats and bimetallic thermoswitches can be jumpered (i.e., shorted), thus allowing the appliance to exceed the specified safe operating temperature limit.

Safety limit strings cause the immediate shut down of a heating element (e.g., a gas burner or electric heating coil) in response to detection of a malfunction in one of the system components having a corresponding switching device in the safety limit string. Prior art electronic controllers have one or more control board inputs for connecting switching devices (e.g., High Limit/ECO, air pressure switch, gas pressure switch, flow switch, etc.) to the controller (which is typically microprocessor- or microcontroller-based). Switching devices connected to control board inputs can have their status monitored by the controller. However, switching devices connected to the control board inputs are also directly connected into the safety limit string. This dual-purpose connection functionally limits the use of switching devices connected to the controller, since they must also exist within the safety limit string and will interrupt power to a heating element (e.g., a 24 VAC gas valve) in the event of an open switch condition.

If a switching device is meant for use as a means to monitor a condition within the appliance and not meant to provide any limiting control to the heating element, then the switching device must be connected external to the controller (i.e., outside the control board inputs), which in turn limits or eliminates the capability of the controller to monitor the status of a switching device, since the controller can only monitor switching devices physically connected to control board inputs. This prior art control system design can lead to the connection of a large number of non-critical switching devices into the safety limit string, so that the controller can monitor operating conditions within the appliance. As a result, the heating element may be subject to shut-down under conditions which do not necessitate a shut-down.

An igniter current proving circuit is used in a gas-fired appliance which uses a hot surface igniter to ignite a flammable gas (e.g., natural gas). The igniter current proving circuit establishes whether the current provided to the hot surface igniter is sufficient to ignite the flammable gas. If flammable gas is released before the hot surface igniter has become hot enough (from the flow of current) to ignite the gas, there could be a build up of flammable gas that could lead to an explosion or fire. Prior art igniter current proving circuits do not provide means for evaluating the condition of the hot surface igniter for the purpose of maintenance and replacement. Accordingly, there is a need for a igniter current proving circuit having a greater level of intelligence.

A flame detection circuit detects the presence/absence of a flame. If a flame is absent the respective gas valve must be closed to prevent the buildup of gas. Prior art flame detection circuits do not provide means for evaluating the quality of a flame, as well as means for monitoring the degradation of a flame probe located in the flame. Accordingly, there is a need for a flame detection circuit having additional detection features.

The present invention addresses these and other drawbacks of prior art appliance control system designs to provide a control system which has improved intelligence, versatility, convenience, and efficiency.

SUMMARY OF THE INVENTION

According to the present invention there is provided a fully integrated electronic appliance control system for controlling the operation of an appliance. The controller includes an integrated intelligent control system; enhanced safety features including an igniter current proving circuit, a configurable safety limit string and an energy cut-out (ECO) circuit; and an intelligent user interface including a display unit and a communications system.

A main control unit includes a processing unit (e.g., a microcontroller or microprocessor) which governs all temperature and ignition control functions for a gas-fired appliance. The main control unit continuously performs various diagnostic tests to verify proper appliance and control operation. Should an unsafe condition occur, the controller will shut down the respective burner and provide the user with appropriate diagnostic indicators. All operating control programs are stored in a permanent memory. A second programmable memory is provided for retaining user specific operating parameters in the event main power is ever interrupted.

An advantage of the present invention is the provision of an appliance control system having integrated control of an appliance.

Another advantage of the present invention is the provision of an appliance control system having an igniter current proving circuit for verifying the presence of a hot surface for igniting a flammable gas.

Another advantage of the present invention is the provision of an appliance control system having a processing unit for evaluating the quality of a hot surface igniter for igniting a flammable gas.

Another advantage of the present invention is the provision of an appliance control system having a flame detection circuit for verifying the presence of a flame.

Still another advantage of the present invention is the provision of an appliance control system having a processing unit for evaluating the quality of a flame.

Still another advantage of the present invention is the provision of an appliance control system having a processing unit for monitoring degradation of a flame probe.

Still another advantage of the present invention is the provision of an appliance control system having a "configurable" safety limit string for closing all gas valves in the event of a malfunction.

Still another advantage of the present invention is the provision of an appliance control system having a processing unit for monitoring conditions in the safety limit string to identify the source of a malfunction.

Still another advantage of the present invention is the provision of an appliance control system that allows a processing unit to monitor switches that are excluded from the safety limit string.

Still another advantage of the present invention is the provision of an appliance control system having an ECO circuit that has improved reliability and temperature tolerances.

Still another advantage of the present invention is the provision of an appliance control system having a comprehensive self-diagnostic system for identifying and locating malfunctions, and for providing diagnostics to an operator.

Yet another advantage of the present invention is the provision of an appliance control system having a communications port for remote communications.

Yet another advantage of the present invention is the provision of an appliance control system adapted for intelligent and efficient control of a remote storage tank.

Still other advantages of the invention will become apparent to those skilled in the art upon a reading and understanding of the following detailed description, accompanying drawings and appended claims.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

It should be appreciated that while a preferred embodiment of the present invention is described with particular reference to an appliance control system for controlling a gas-fired water heating device, the present invention is contemplated for use with other appliances, including those which generate heat using electricity, a heat pump, oil and the like. In addition, the gas-fired heating appliance may use a variety of suitable ignition systems, including standing pilot ignition, spark ignition and hot surface ignition. Moreover, it should be understood that the term "hot water heater" generally refers to a water heating device for heating potable water, while the term "boiler" generally refers to a water heating device for heating process water (e.g., water for industrial and space heating applications). For purposes of the present application, the terms "hot water heater" and "boiler" will be used interchangeably to refer to a water heating device.

Figure 1:
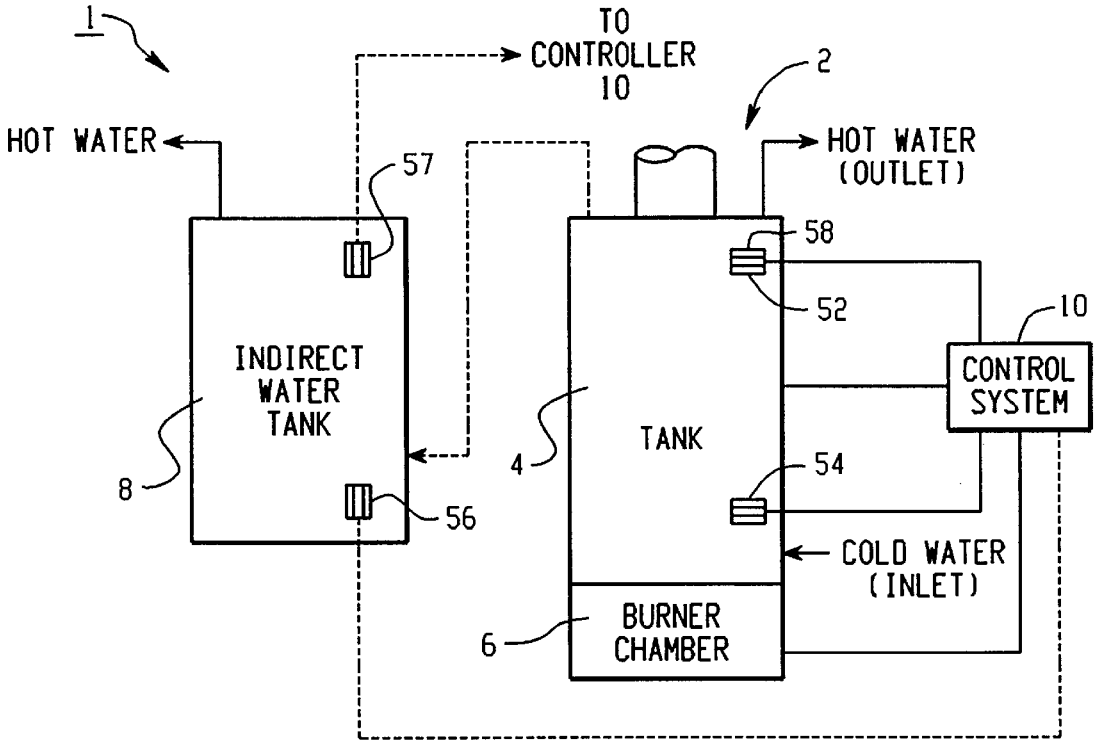
FIG. 1 is a block diagram of a water heating system including the appliance control system of the present invention.

Referring now to the drawings wherein the showings are for the purposes of illustrating a preferred embodiment of the invention only and not for purposes of limiting same, FIG. 1 shows a block diagram of a water heating system 1. Water heating system 1 is generally comprised of a water heater 2 having a water heater tank 4 and a burner chamber 6, and an appliance control system 10. Burner chamber 6 houses a main burner and an ignition system (e.g., standing pilot ignition, spark ignition or hot surface ignition). In addition, an optional indirect water tank 8 is shown as connected with water heater 2 and control system 10. Operation of water heating system 1 will be provided in detail below.

Figure 2:
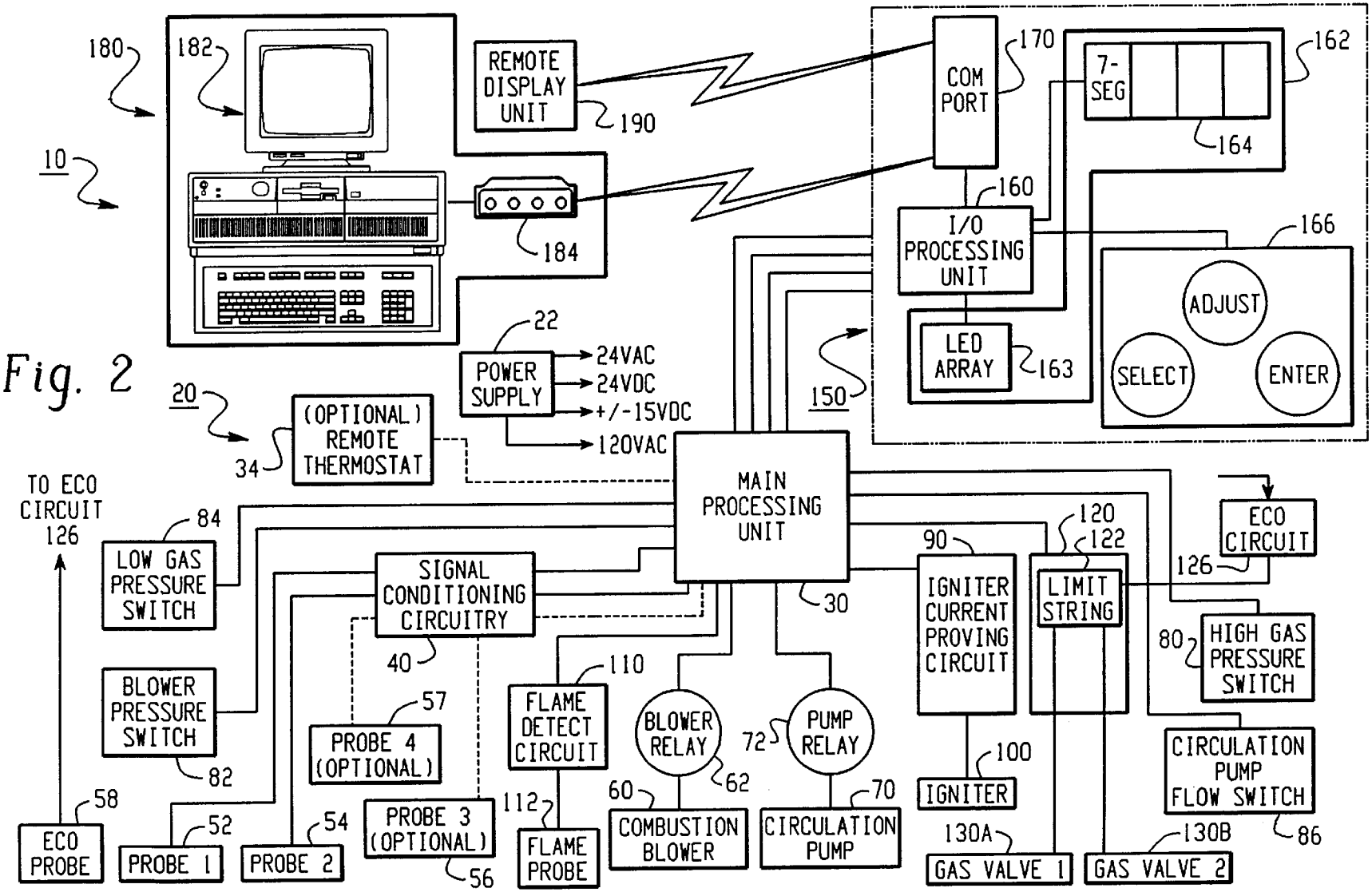
FIG. 2 is a block diagram of the appliance control system, according to a preferred embodiment of the present invention.

Referring now to FIG. 2, there is shown a detailed block diagram of control system 10, according to a preferred embodiment of the present invention. Control system 10 is generally comprised of a main control unit 20 and an I/O control unit 150, which are connected together. Main control unit 20 is generally comprised of a power supply 22, a main processing unit 30, a plurality of probes (including a first temperature probe 52, a second temperature probe 54, an optional third temperature probe 56, an optional fourth temperature probe 57, an ECO probe 58 and a flame detection probe 112), a plurality of switches (including a circulation pump pressure switch 80, a blower pressure switch 82, a low gas pressure switch 84, and a high gas pressure switch 86), a combustion blower relay 62 for controlling a combustion blower 60 and a circulation pump relay 72 for controlling a circulation pump 70.

Main control unit 20 also includes an igniter current proving circuit 90 for receiving signals from hot surface igniter 100, a flame detection circuit 110 for receiving signals from flame probe 112, a gas valve safety circuit 120 for controlling first and second gas valves 130A, 130B, and an optional remote thermostat 34. It should be noted that the signals generated by probes 52, 54, 56 and 57 are input to a signal conditioning circuit 40, while signals generated by ECO probe 58 are input to ECO circuit 126. Moreover, it should be appreciated that in a preferred embodiment of the present invention, the ECO probe 58 and first temperature probe 52 are located within the same thermowell housing (thus forming a single probe unit), the construction of the housing maintaining electrical isolation between the ECO probe and temperature probe. A detailed description of each component of main control unit 20 is provided below.

I/O control unit 150 is generally comprised of a I/O processing unit 160, a display unit 162, an input unit 166, and a communications port 170. Communications port 170 allows a remote processing system 180 to communicate with main control unit 20. I/O control unit 150 and remote processing system 180 will be described in detail below. It should be appreciated that in a preferred embodiment of the present invention, I/O control unit 150 is locatable remote from main control unit 20, so that the components of the I/O control unit 150 can be located for convenient operator access.

Power supply unit 22 provides an appropriate voltage to the various components of main control unit 20. In this regard, power supply unit 22 includes a fused section which receives 24VAC power from the secondary of a class II appliance transformer and routes it to relay contacts for driving safety circuit switches, a 24VAC igniter 100 and other elements. Power supply unit 22 also includes a half-wave rectified section, which half-wave rectifies and signal conditions the 24VAC signal to provide a regulated 24VDC for relay switch coils, and display unit 162, ±15VDC for igniter current proving sense circuit 90, and an energy cut-out (ECO) circuit (discussed below) and 5VDC for logic. In addition, power supply unit 22 includes input terminations for 120VAC to power flame probe 112, combustion blower 60, combustion blower 60, or a 120VAC igniter 100.

Main processing unit 30 provides overall control of control system 10. In a preferred embodiment, main processing unit 30 takes the form of an 8-bit microcontroller having an analog-to-digital (A/D) converter for converting analog voltages to corresponding digital values. Main processing unit 30 also includes memory storage means for storing data. For instance, main processing unit 30 may take the form of a 28-pin SGS Thompson ST6225B processor. This processor has a high immunity to noise and a relatively robust clock circuit as compared to many other processors. A 1K bit EEROM stores data such as set point temperatures, set point temperature differentials, etc.

Temperature probes 52, 54, 56 and 57 are connected to main processing unit 30 via signal conditioning circuit 40, as shown in FIG. 1. Probes 52, 54, 56 and 57 preferably take the form of thermistors (e.g., 10 Kohm negative temperature coefficient thermistors). Thermistors have a resistance characteristic that varies inversely and non-linearly with temperature. The function of signal conditioning circuitry 40 is to convert a thermistor resistance-versus-temperature relation into a voltage-versus-temperature relation. The thermistor is used in a half bridge configuration with a fixed resistor to form a voltage divider circuit with one leg connected to regulated D.C.(e.g., 5V DC) and the other end connected to circuit common. As the thermistor temperature rises, its resistance decreases, and hence, the divider bridge output voltage of signal conditioning circuit 40 decreases. To maintain the temperature tolerance, precision fixed resistors (low tolerance/low temperature coefficient) are used. In a preferred embodiment, the thermistors provide 10K ohms at 25 degrees C. The output of signal conditioning circuit 40 is input to the A/D converter of main processing unit 30 to generate a corresponding digital value representative of the sensed temperature.

With reference to FIG. 1, first probe 52 senses the water heater outlet water temperature. Second probe 54 senses the water heater inlet water temperature. Accordingly, a differential temperature value (i.e., outlet temperature minus inlet temperature) can be determined. Third probe 56 and fourth probe 57 are optional probes, which are used in water heating systems having an indirect water tank (described below). It should be appreciated that main processing unit 30 detects the absence or presence of any or all of the probes (e.g., probes 52, 54, 56 and 57), and prioritizes heat demand signals accordingly.

Circulation pump 70 is connected with main processing unit 30 via pump relay 72. Circulation pump 70 circulates the water inside water heater tank 4. Combustion blower 60 is connected with main processing unit 30 via blower relay 62. Combustion blower 60 blows gas out of burner chamber 6, and may have one or more speeds.

Circulation pump flow switch 80, blower pressure switch 82, low gas pressure switch 84, and high gas pressure switch 86 are preferably powered by 24VAC from power supply unit 22. The outputs of these switches are read directly by main processing unit 30. Circulation pump flow switch 80 is used to verify that there is water inside water heater tank 4. In this regard, circulation pump flow switch 80 is located at the outlet to detect the flow of water when circulation pump 70 has been activated. Preferably, circulation pump flow switch 80 takes the form of a microswitch. Blower pressure switch 82 is used to verify that combustion blower 60 is generating pressure in burner chamber 6, when combustion blower 60 is activated. In this regard, blower pressure switch 82 responds to the pressure in burner chamber 6. Switch 82 is closed when the pressure reaches a predetermined level. Low gas pressure switch 84 and high gas pressure switch 86 respond to the pressure of the gas on the line side of the gas valve. In this regard, pressure switches 84 and 86 are respectively adapted to respond to low and high gas pressure thresholds. Low gas pressure switch 84 will open in response to a low gas pressure in the gas line, while high gas pressure switch 86 will open in response to a high gas pressure in the gas line.

It should be appreciated that main control unit 20 may also include a blocked flue switch and blocked inlet switch in addition to, or in place of, low gas pressure switch 84 and high gas pressure switch 86. The blocked flue switch is a pressure switch which responds to the pressure in the flue. Accordingly, the blocked flue switch will open in response to a blocked flue. The blocked inlet switch is a pressure switch which responds to the pressure at the air inlet to combustion blower 60. Accordingly, the blocked inlet switch will open in response to a blocked inlet.

It should be appreciated that an input sense matrix (i.e., diode matrix) may be used to monitor the state of system relay switches to verify whether the relay is open or closed, and to monitor the state of external 24 VAC sensor inputs (e.g., pressure switches or other contact closures). An input sense matrix acts like a multiplexer to reduce the number of input lines required by main processing unit 30. It should be appreciated that in a preferred embodiment of the present invention all 120VAC signals (e.g., circulation pump 70 and combustion blower 60) verifying operation are fed back to main processing unit 30 through opto-isolators.

Igniter current proving circuit 90 will now be described with reference to FIG. 3. Igniter current proving circuit 90 proves the presence of "hot" surface igniter 100 by validating the igniter current flowing therethrough. Failure to establish igniter current will prohibit respective gas valve operation, which in turn prevents the buildup of gas which could cause an explosion when ignited by igniter 100.

Igniter current proving circuit uses a current sense transformer 92, which is fed into a summing junction of an op-amp 94 through a resistor R9 whose value is the recommended load for current sense transformer 92. A feedback resistor R8 is selected such that the peak voltage is proportional to the RMS current flowing through igniter 100. In a preferred embodiment, RMS current is selected to be 1 volt per amp of igniter current. Resistor R12 provides current limiting and filtering, and a peak hold capacitor C5 filters out the AC. A DC voltage on capacitor C5 is input to main processing unit 30. Resistor R11 is provided for discharging capacitor C5.

The DC voltage on capacitor C5 is converted to a digital value by an A-to-D converter (which is preferably a part of main processing unit 30). The digital value is used by the main processing unit to determine the validity of the igniter current. The digital value can also be used as a diagnostic tool by being displayed to the operator on the display unit.

Figure 3:
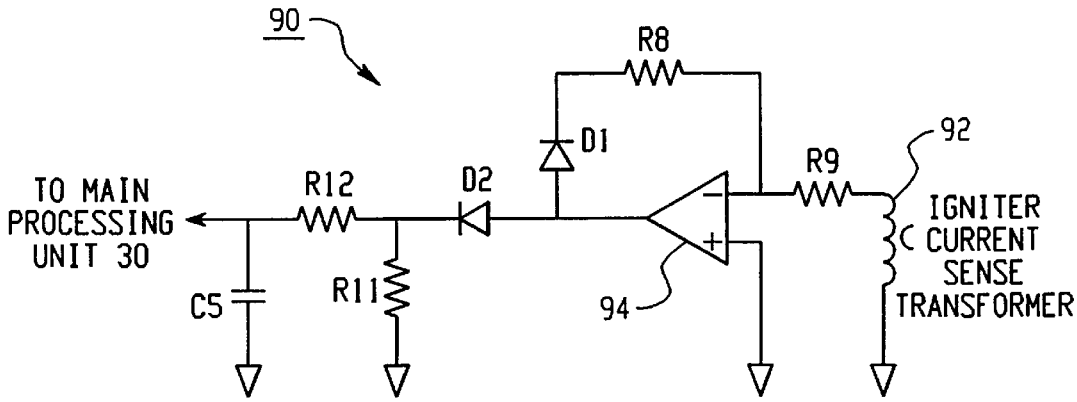
FIG. 3 is a schematic diagram of an igniter current proving circuit, according to a preferred embodiment of the present invention.

It should be appreciated that the circuit design shown in FIG. 3 is only exemplary, and that other circuit designs for generating a voltage corresponding to the igniter current are also suitable.

Igniter current proving circuit 90, in connection with main processing unit 30, can also be used to monitor the condition of igniter 100, rather than sensing only whether an appropriate current is present or absent. In this regard, main processing unit 30 is programmable to compare the current digital value (representing the present measured current value) to a previously stored digital value (representing a predetermined current value). The digital values may be stored in the memory of main processing unit 30. Degradation of igniter 100 can be monitored by comparison to the previously stored value(s).

It should be understood that by having knowledge of the digital values representing current values, it can be determined how long to make the warm-up time to warm up the igniter. The warm-up time must be sufficient to allow the igniter to heat to a level that will ignite the gas. Moreover, the igniter warm-up time can be modified to a level suitable for different components. For, example, different igniter components may require different warm-up times. Furthermore, by obtaining specific digital values the actual current can be "proven" (i.e., the current is at a level that will ignite the gas), as opposed to merely detecting the presence or absence of a current.

It should be understood that control system 20 may include multiple igniter current sense transformers, where each transformer is used in connection with a different igniter, or as a backup.

Flame probe 112 is located in a gas flame (e.g., main burner flame or pilot flame), and detects the presence of a flame using a well known technique referred to as "flame rectification." Flame probe 112 preferably takes the form of a suitable flame rod.

Figure 4:
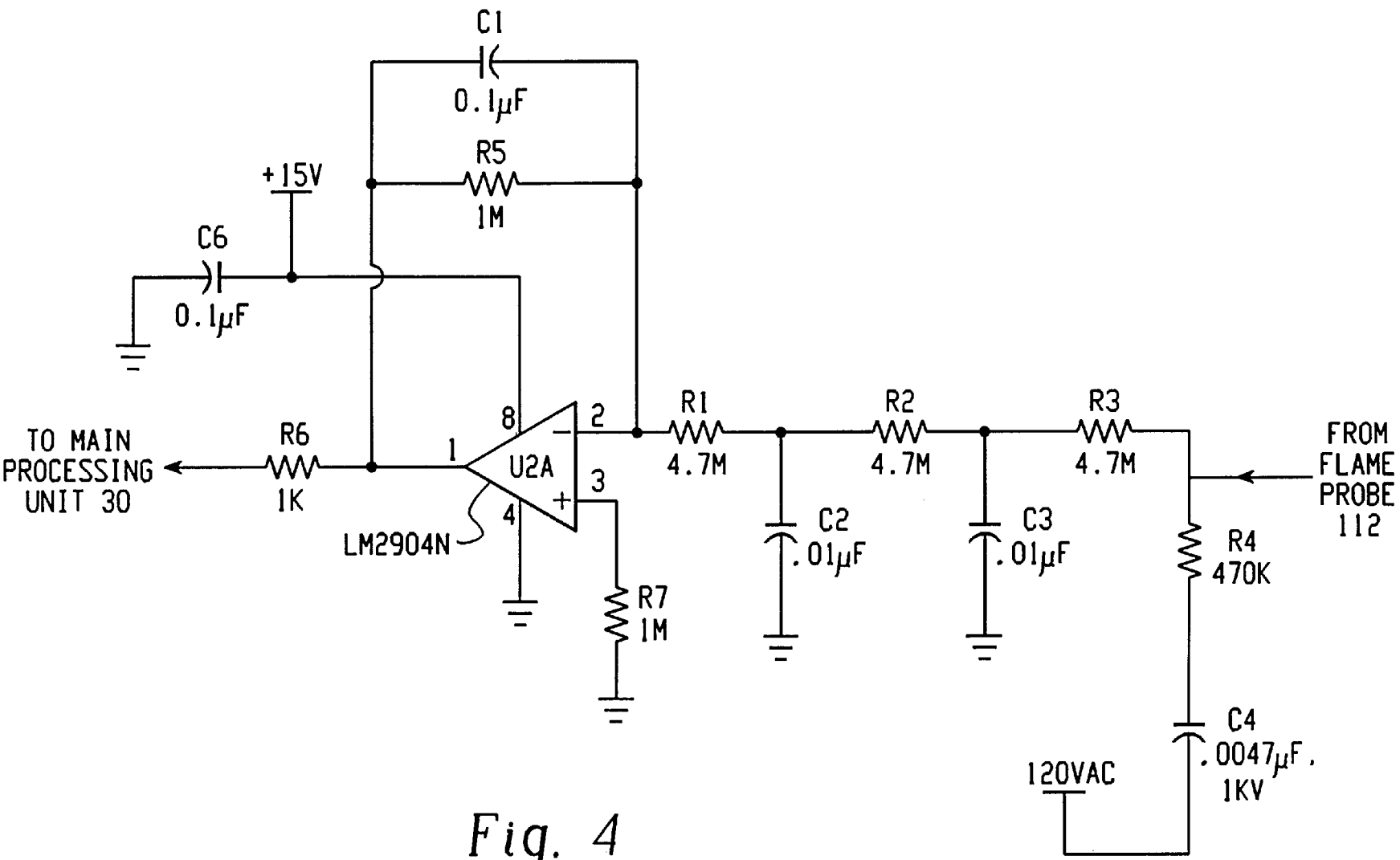
FIG. 4 is a schematic diagram of a flame detection circuit, according to a preferred embodiment of the present invention.

Flame detection circuit 110 will now be described in detail with reference to FIG. 4. The ions generated by a flame are alternately emitted and collected by flame probe 112 with respect to the grounded burner. Due to the relative sizes of flame probe 112 and the burner, the flow of current is better with one polarity than the other. Thus, the flame looks like a poor quality rectifier.

The power line voltage (120VAC) is capacitively coupled through capacitor C4 and resistor R4 to flame probe 112. If there is no flame present, then the resultant DC voltage is essentially zero. If a flame is present, the "flame rectifier" will cause the DC voltage to shift negative, due to the clamping action of the rectifier and capacitor C4. This DC voltage will cause current to flow through the resistors R1, R2, and R3 to the summing junction of op-amp U2A. This current will be balanced by op-amp U2A by making the op-amp's output go positive to produce a current equal to the output voltage divided by the feedback resistor R5. Capacitors C3, C2, and C1 filter out the line frequency to produce a DC voltage at output pin 1 of op-amp U2A. The DC voltage is indicative of the flame current value. Resistor R6 protects the microprocessor input (i.e., main processing unit 30) when the flame current exceeds full scale of the A/D converter. This flame current measurement is used by main processing unit 30 to determine the presence/absence of a flame, as well as the quality of the flame. For example, a flame current in the range of 1 to 10 microamps may be deemed a "high quality" flame.

In addition, the flame current measurement can be used to monitor degradation of the flame probe itself, for diagnostic and maintenance purposes. In this respect, the present measured value is compared to one or more previously measured values or a predetermined value (which may be stored in the memory of main processing unit 30). Degradation may result from the buildup of silicon deposits forming on the flame rod. The deposits will insulate the flame rod from the flame. Accordingly, as the deposits continue to build up, the flame current decreases.

In an alternative embodiment of the present invention, the flame detection circuit includes a JFET. The gate of the JFET replaces the summing junction of the op-amp. Flame probe 112 senses the ions generated by the flame, the absence or presence of which drives the output of the JFET low or high. Main processing unit 30 reads the output of the JFET to determine the status of the flame. Failure to establish a flame results in shutdown of the respective gas valve.

It should be understood that control system 20 may include multiple flame probes, where each flame probe is used in connection with a different burner flame, or as a backup.

In an alternative embodiment of the present invention, flame probe 112 is replaced by igniter 100. In this regard, control system 20 is modified to allow igniter 100 to serve dual purposes (i.e., igniter and flame probe). In this embodiment, switching circuitry is provided to selectively switch the circuitry connected to igniter 100. Initially, igniter 100 is connected to igniter current prove circuit 90. After ignition has been completed, igniter 100 is connected to flame detection circuit 110. Igniter 100 responds to the presence of a flame in the same manner as flame probe 112.

Remote external thermostat 34 is optionally connected with main processing unit 30. When remote external thermostat 34 is in use (e.g., by removal of a shorting jumper), main processing unit 30 looks for an external thermostat signal which overrides the local set point temperature provided by I/O control unit 150.

Gas valve safety circuit 120 will now be described with reference to FIGS. 2 and 5. Gas valve safety circuit 120 is generally comprised of a limit string 122, which includes a fuse and a series of switches. The intent of limit string 122 is to provide a means of interrupting power to the heating element (e.g., gas valve, electric heating coil, etc.) in the event of an unsafe operating condition. Accordingly, limit string 122 requires that a series of conditions be true (evidenced by closed switches) before voltage (e.g., 24VAC) is applied to open a gas valve. In this respect, limit string 122 provides a safety link for applying 24VAC to gas valves 130A and 130B. Gas valves 130A and 130B control the flow of gas to a respective burner (e.g., a main burner or pilot light). For instance gas valve 130A may provide "low gas," while gas valve 130B provides "high gas". In some cases both gas valves may be ON, while in other cases only one of the two gas valves may be ON. Alternatively, gas valve 130A may provide gas to the pilot light, while gas valve 130B provides gas to a main burner.

According to a preferred embodiment of the present invention, limit string 122 includes (but is not limited to) the following:

1. Fuse F1;
2. ECO relay switch K9;
3. Circulation pump flow switch 80;
4. Blocked flue switch;
5. Master gas valve relay switch K6
6. Gas valve relay switches K7 and K8

Fuse F1 is preferably a 3A auto fuse, such as Littlefuse 3A automotive fuse (part no. 257003). ECO relay switch K9 is responsive to an ECO system 124, which is described in detail below. Circulation pump flow switch 80 and the blocked flue switch are as described above. With regard to the gas valve relay switches, master switch K6, (valve 1) switch K7 and (valve 2) switch K8 are response to signals from main processing unit 30. Master switch K6 is a "redundant" switch that always makes and breaks first, which ensures that arcing will only occur across switches K7 and K8. If the contacts of switches K7 or K8 (or both) should ever weld shut (i.e., welded contact failure), "redundant" master switch K6 can still interrupt current to the gas valves 130A, 130B. Main processing unit 30 monitors the position of switches K6, K7, and K8 at points D, E, and F respectively, and if any fail to operate correctly it will close the respective gas valve (i.e., open switches K6, K7 and/or K8).

Figure 6:
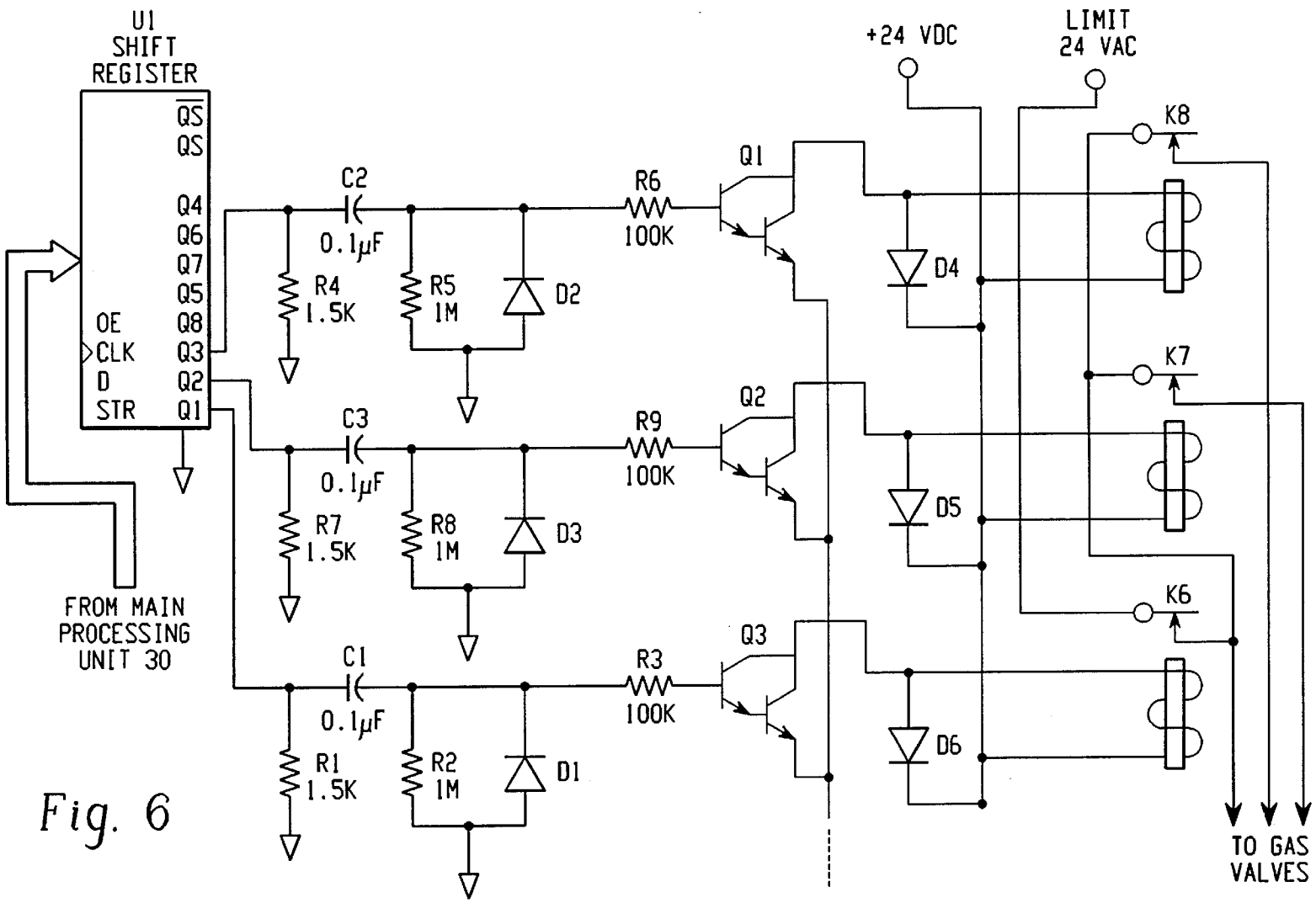
FIG. 6 is a schematic diagram illustrating a circuit for interfacing the gas valve relay switches with the main processing unit, according to a preferred embodiment of the present invention.

It should be appreciated that in a preferred embodiment of the present invention, control signals provided by main processing unit 30 for controlling gas valve relays K6, K7 and K8 are input to shift register U1, the outputs of which are capacitively coupled to darlington relay drivers (Q3, Q2 and Q1, respectively), as shown in FIG. 6. Shift register U1 maintains its output via generation of clock and output enable signals from main processing unit 30. In a preferred embodiment the coupling capacitors (C1, C3 and C2) are charged through a respective 1.5K resistor (R1, R7 and R4) and a diode (D1, D3 and D2) during the approximately 100 microseconds of shift time to load shift register U1, which generates a square wave. The coupling capacitors will discharge with a time constant of approximately 10 ms to turn off gas valve relay switches K6, K7 and K8 (which in turn closes the respective gas valves) in the event of failure of main processing unit 30 or shift register U1.

According to a preferred embodiment of the present invention, ECO system 124 is comprised of an ECO circuit 126 and an ECO probe 58 (e.g., thermistor). ECO probe 58 is located at first probe 52 to sense a high-limit temperature. ECO circuit 126 evaluates the data received from ECO probe 58, and operates independently of main processing unit 30. In this regard, ECO circuit 126 includes circuitry for determining whether the temperature has exceeded a "high limit" temperature (e.g., 250 degrees F.), whether there is a shorted ECO probe, and whether there is an open ECO probe. When any of these conditions are sensed, ECO circuit 126 causes relay switch K9 to open, which in turn closes the gas valves.

Figure 7A:
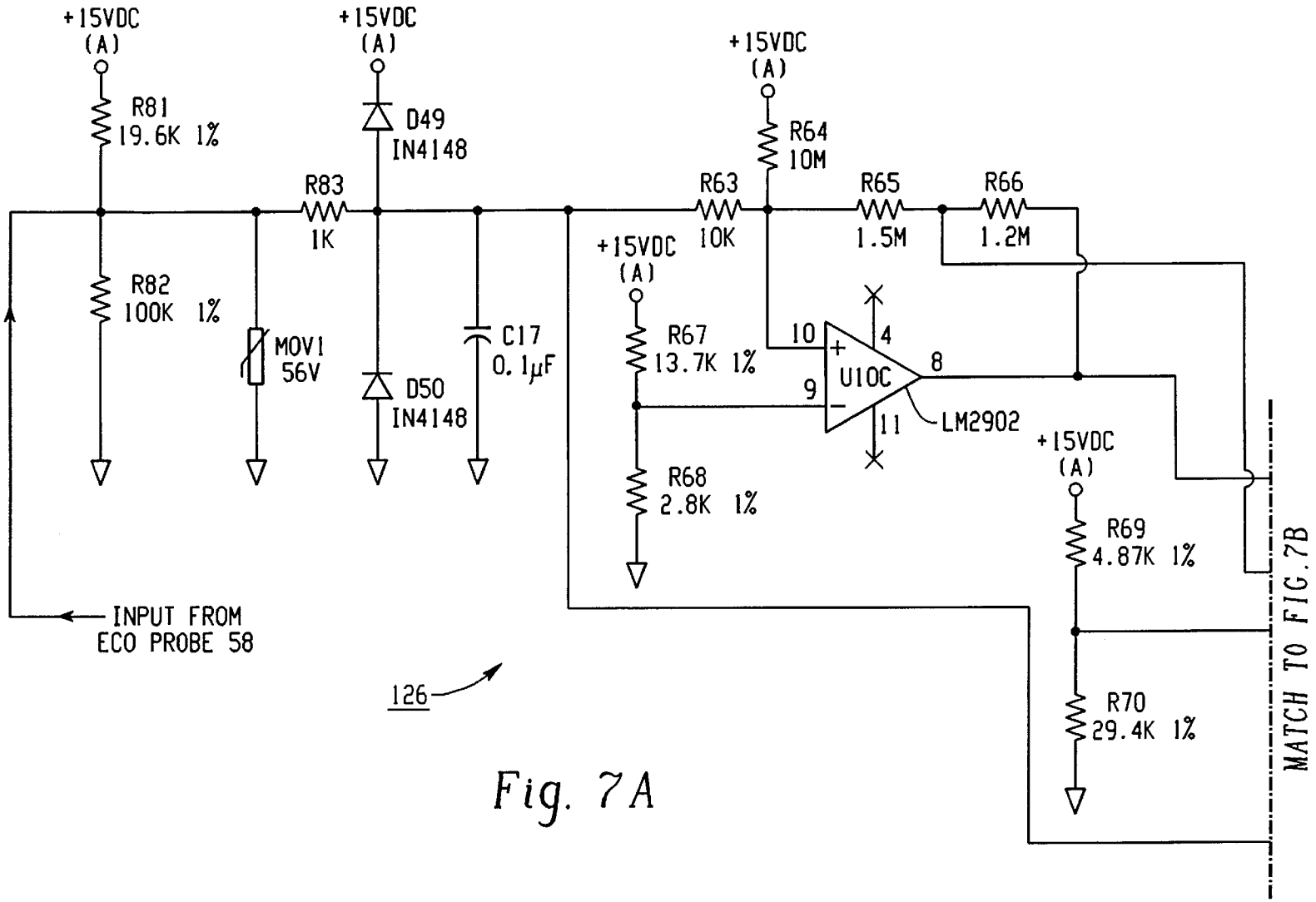
FIGS. 7A and 7B are a schematic diagram of an energy cut-out (ECO) circuit, according to a preferred embodiment of the present invention.
Figure 7B:
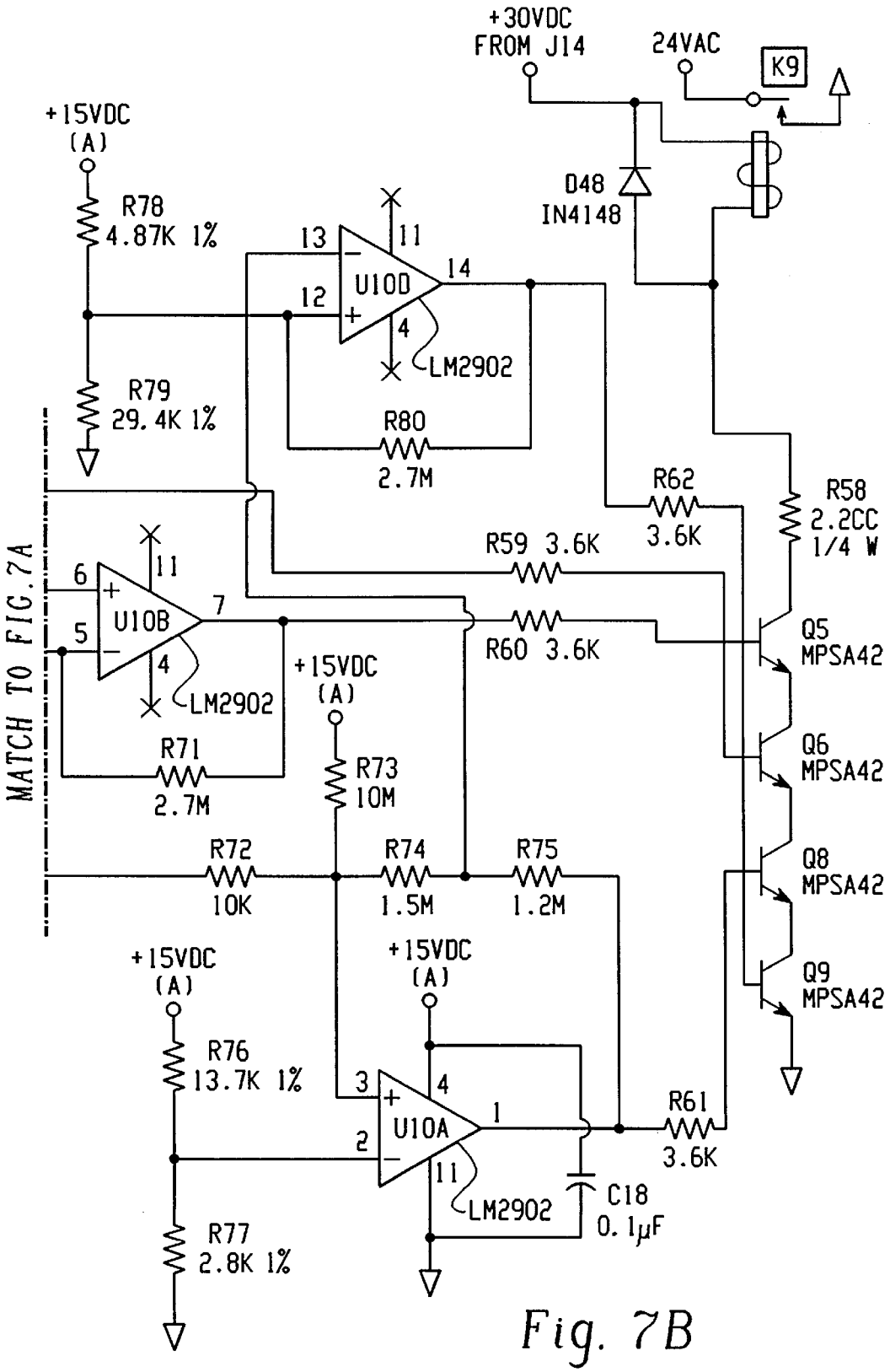

Referring now to FIGS. 7A and 7B, there is shown a preferred embodiment of ECO circuit 126. ECO circuit 126 is generally comprised of high-limit circuitry and probe fault circuitry. With regard to the high-limit circuitry, a desired ECO high-limit temperature is obtained from a resistive voltage divider connected between regulated DC and common. The resistive voltage divider provides an analog voltage corresponding to the voltage produced by ECO probe 58 (i.e., thermistor) when the high-limit temperature is reached. Precision fixed resistors (low tolerance/low temperature coefficient) are used in the resistive voltage divider to set the voltage limit. This voltage dividing network can be "tuned" to suit a variety of application driven high-limit temperatures by substitution of standard value resistors.

In a preferred embodiment, the high-limit circuitry is comprised of two redundant circuits (1) a primary high-temperature limit circuit (op-amp U10C, switch Q6, and resistors R59, R66, R65, R64, R63, R68, and R67), and (2) a secondary high-temperature limit circuit (op-amp U10A, switch Q8, and resistors R73, R61, R75, R74, R72, R77, and R76). These two circuits, along with resistors R81 and R82 that linearize the thermistors, process the thermistor and high-limit voltages and are run open loop (i.e., no negative feedback), but have a small amount of hysteresis in the form of positive feedback that creates dead band at the control point. This dead band is about 1.5 degrees F. (±0.5 degrees F.) but may be changed by changing the positive feedback resistor value. The dead band, in conjunction with the tolerance stack up of the resistors in the set point and thermistor dividers (in addition to the tolerance of the thermistor) provides the overall temperature tolerance (or switching differential) of the ECO circuit.

With regard to the primary high-temperature limit circuit, op-amp U10C receives at input pin 9 a reference voltage indicative of the high-limit temperature, while input pin 10 receives an input voltage indicative of the temperature sensed by ECO probe 58. As the temperature sensed by the ECO probe increases, the input voltage decreases. When the temperature sensed by the ECO probe reaches or exceeds the high-limit temperature, the input voltage will drop below the reference voltage. Consequently, the output voltage at pin 8 will drop to a level causing transistor switch Q6 to turn OFF. When any one of the series switches Q5, Q6, Q8 or Q9 is turned OFF, switch K9 is opened (i.e., turned OFF), which in turn closes the gas valves. Secondary high-temperature limit circuit operates in a similar manner as primary high-temperature limit circuit, and is provided as a redundant safety backup in the event of a component failure in the primary high-temperature limit circuit.

It should be understood that in the event that ECO probe 58 is short-circuited, the gas valves will close. This will occur because a shorted probe will indicate a very high temperature (exceeding the high-limit temperature) to the primary and secondary high-temperature limit circuits, and they will respond accordingly. However, in the case of an open-circuit ECO probe, probe fault circuitry is used to open relay switch K9, and thus close the gas valves. In a preferred embodiment, probe fault circuit monitors the ECO probe input signal with (1) a primary open probe detection circuit (op-amp U10D, switch Q9, resistors R62, R80, R79 and R78), and (2) a secondary open probe detection circuit (op-amp U10B, switch Q5, resistors R60, R71, R70, and R69). Op-amp U10D receives at input pin 12 a reference voltage indicative of an open probe threshold temperature. In a preferred embodiment, the reference voltage is set to represent an open probe low limit temperature of about 30 degrees F. using a resistor voltage divider. At input pin 13, op-amp U10D receives an input voltage indicative of the temperature sensed by ECO probe 58. As the temperature sensed by the ECO probe decreases, the input voltage increases. When the temperature sensed by the ECO probe reaches or drops below the open probe threshold temperature, the input voltage will exceed the reference voltage. Consequently, the output voltage at pin 14 will drop to a level causing transistor switch Q9 to turn OFF. As indicated above, when any one of the series switches Q5, Q6, Q8 or Q9 is turned OFF, switch K9 is opened (i.e., turned OFF), which in turn closes the gas valves. Secondary open probe detection circuit operates in a similar manner as primary open probe detection circuit, and is provided as a redundant safety backup in the event of a component failure in the primary open probe detection circuit.

As indicated above, ECO circuit 126 includes redundant circuits to provide a second order failure tolerance. To achieve a high degree of reliability, transient protection circuitry (metal-oxide varistor MOV1, resistor R83, diode D49, diode D50, and capacitor C17) is provided, along with diode D48 (relay snubber diode) and short circuit protection resistor R58.

It should be appreciated that above-described embodiment of ECO system 124 provides significant improvements in both temperature range and temperature tolerance (±2½ deg. F., typ.) versatility. The temperature tolerance is especially significant for installations requiring the running control set point temperature to be very close to the ECO high-limit temperature without actually reaching it. Depending on the applicable standard for the appliance, opening of the ECO high limit may require that the appliance go into lockout condition, requiring a manual reset prior to power on. In addition, the ECO system interrupts power to a relay coil with the load (up to 10 amps) going across the relay contacts.

In an alternative embodiment of ECO system 124, a conventional bimetallic switch SW1 is substituted for ECO probe 58 and ECO circuit 126. In this embodiment, bi-metallic switch SW1 is located at first probe 52 to sense an overheat condition. Bi-metallic switch SW1 will open in response to sensing a temperature which exceeds its rated temperature (i.e., high-limit temperature). It is noted that bimetallic switches typically have a temperature resolution of only approximately ±3 degrees C. When switch SW1 is opened the 24VDC supply is removed from the coil of relay switch K9. As a result, relay switch K9 opens, thus removing 24VAC from limit string 122. Consequently, control system 10 enters a lockout condition. It should be appreciated that the second embodiment of the ECO system allows for less temperature accuracy than the first embodiment.

In still another alternative embodiment of the present invention, ECO system may take the form of an electronic ECO comprised of a standard thermistor and a software program running on main processing unit 30. The software is factory programmable with a threshold temperature for shutting off the gas valves.

Figure 5:
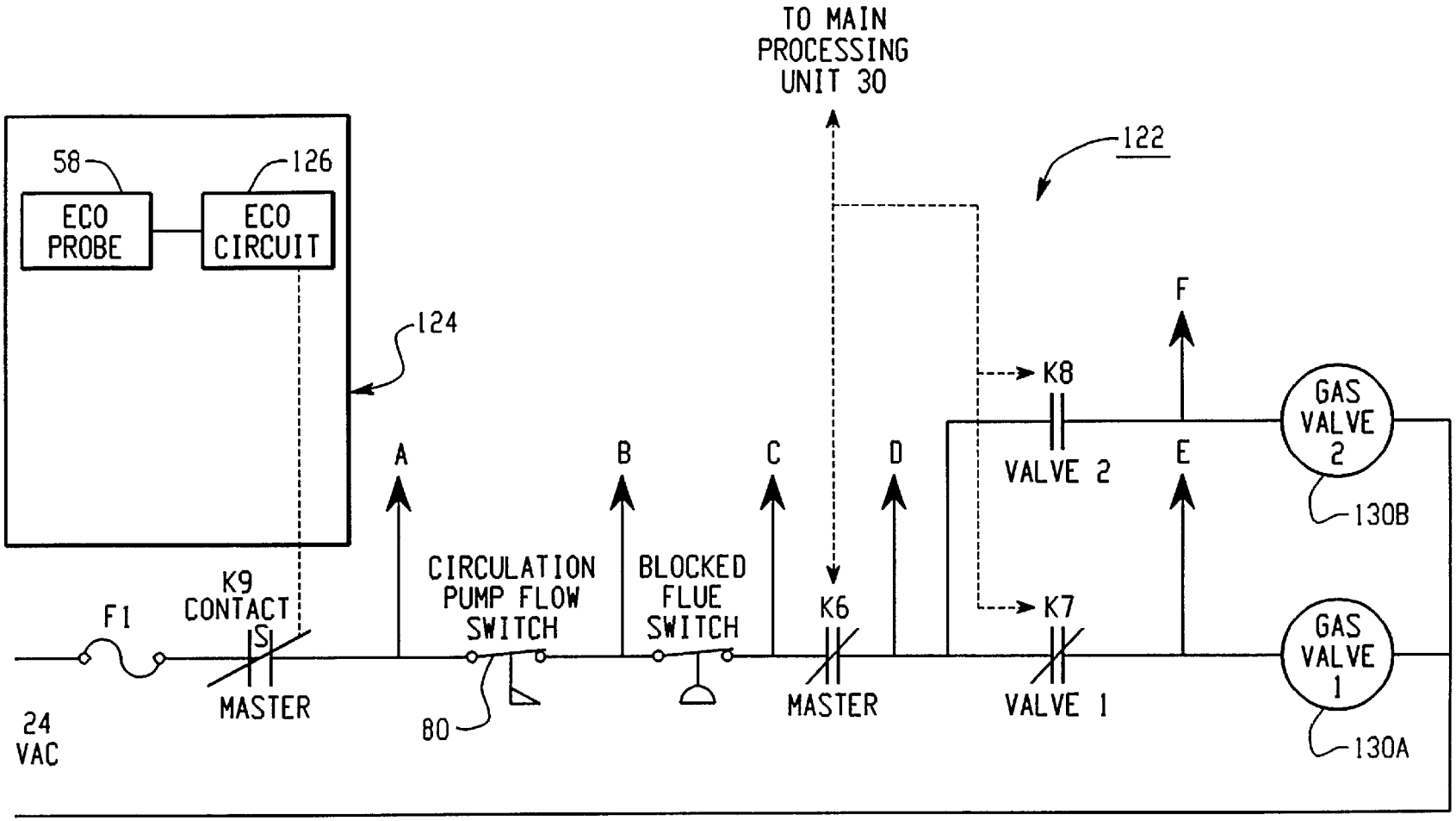
FIG. 5 is a schematic diagram illustrating a limit string, according to a preferred embodiment of the present invention.

It should be understood that main processing unit 30 monitors limit string 122 at various points in order to identify the source of a problem condition, rather than to merely determine that a malfunction or failure has occurred (FIG. 5). In this regard, switch K9 contacts are monitored at point A, circulation pump flow switch 80 contacts are monitored at point B, low gas pressure switch 84 contacts are monitored at point C, master gas valve relay switch K6 contacts are monitored at point D, first gas valve relay switch K7 contacts are monitored at point E, and second gas valve relay switch K8 contacts are monitored at point F.

By the virtue of being able to identify the specific component which is the source of the malfunction, main processing unit 30 can continue operations (e.g., combustion blower) which are not affected by the malfunction, or which may help in minimizing further malfunctions. Main processing unit 30 can also report the identified malfunctioning component to the operator using display unit 162. Main processing unit 30 is not limited to a single default operation in the event of a malfunction or failure, and thus control system 10 can adapt to a given situation. The ability of main processing unit 30 to identify the component which has malfunctioned, and to take intelligent adaptive action, allows for significant improvements in the versatility of control system 10.

It should be appreciated that the embodiment of limit string 122 is shown solely for the purpose of illustrating a preferred embodiment of the present invention. In this regard, limit string 122 may have other configurations and combinations of elements. For instance, the limit string may include the blower pressure switch 82, low gas pressure switch 84, high gas pressure switch 86 and blocked blower inlet switch, as well as other switches responsive to various operating conditions.

As discussed above, devices placed in limit string 122 typically consist of a High Limit/ECO switch, air pressure switch, and/or other safety switches. According to a preferred embodiment of the present invention, limit string 122 is "configurable." In this regard, selected switching devices may be inputs to control system 10, with or without being a part of limit string 122.

Figure 8:
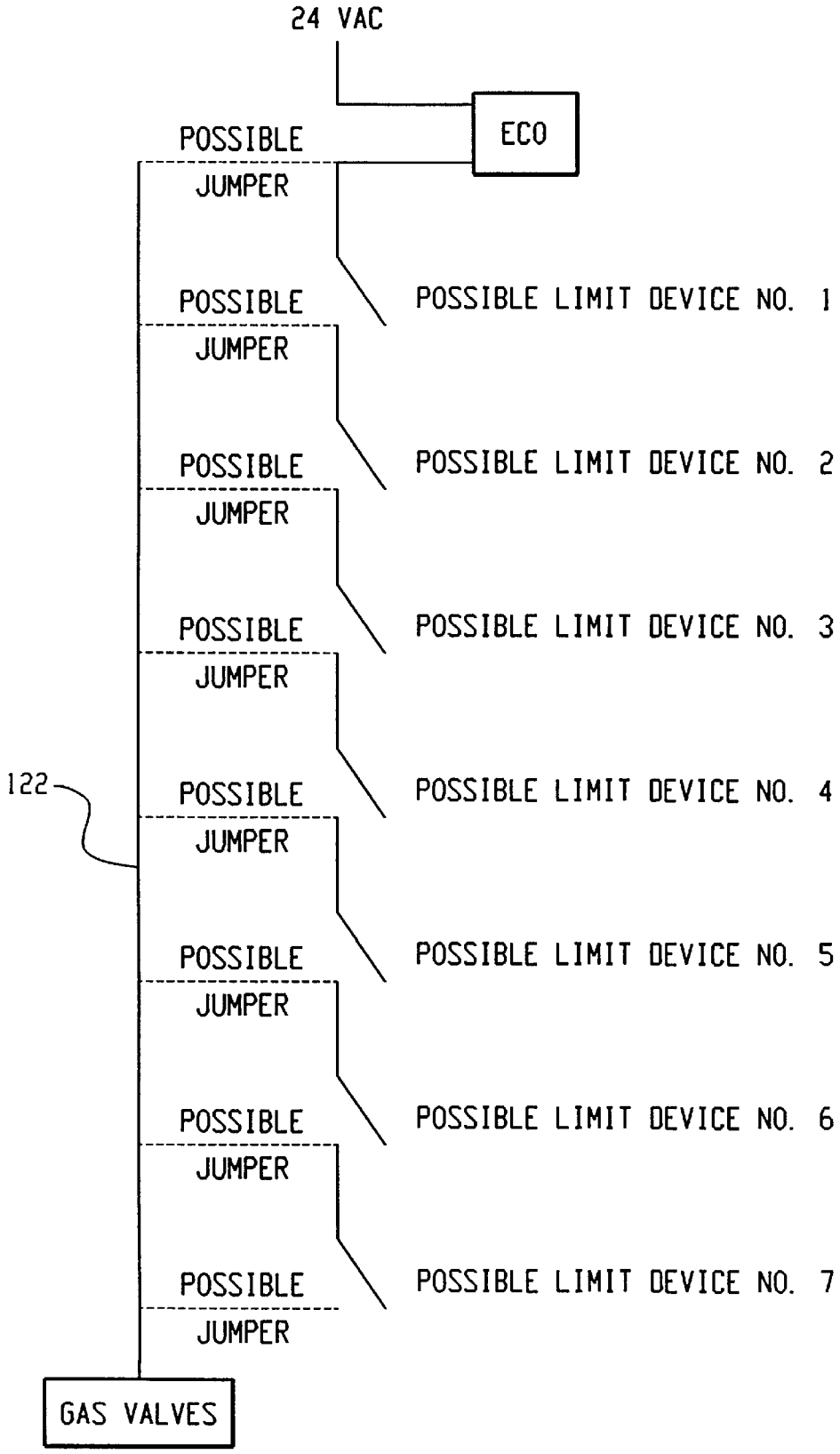
FIG. 8 illustrates the jumpers for configuring the limit string of the present invention.

Referring now to FIG. 8, there is shown a series of jumpers that are provided to configure a switch either in or out of limit string 122. Accordingly, a switching device can be connecting either in series with limit string 122, or external to limit string 122. In either configuration, main processing unit 30 monitors the status of any switching device connected in or out of limit string 122 and provides information concerning the status of each switching device. This "configurable" limit string provides added flexibility for control system 10, and allows for customization of control system 10 for numerous configurations.

It should be appreciated that the "configurable" limit string described above, allows control system 10 to provide full diagnostic capabilities and intelligent analysis of any switching device connected to control system 10. As a result, the present invention provides advanced intelligent operation and control of an appliance by monitoring the status of all appliance switching devices, whether they are connected in or out of the limit string. Utilizing information obtained by monitoring additional switching devices and using display units 162, control system 10 can take such actions as (1) report fault conditions, (2) direct an appliance operator to the source of the problem, (3) perform multiple ignition trials based on switch status, (4) adapt to the situation and continue with safe appliance operation, (5) enter a wait state until the fault condition is corrected, or (6) enter a lockout state requiring user intervention to bring the appliance back to normal operating status.

Moreover, control system 10 allows for simple modifications of the limit string configuration, so that the limit string is suitable to work with several different appliance models utilizing the same basic controller design. As noted above, a series of jumpers are set to customize control system 10 for each unique appliance.

I/O control unit 150 will now be described in detail with reference to FIG. 2. As indicated above, I/O control unit 150 includes I/O processing unit 160, display unit 162, input unit 166 and communications port 170. In a preferred embodiment of the present invention, processing unit 160 takes the form of a microcontroller, such as the 68HC705C8A manufactured by Motorola Corporation. Display unit 162 is comprised of a first display 163 and a second display 164. First display 163 is preferably a 2×8 LED array, while second display 164 is preferably an array of four seven-segment displays.

In a preferred embodiment, first display 163 is used to indicate various states of the appliance. In this regard the LED's indicate a call for heat, flow switch enabled, combustion blower proving, igniter proving, gas valve enabled, and flame sense verified, ignition failure, circulation pump failure, blower failure, low gas pressure or blocked flue, and high gas pressure or blocked inlet.

According to a preferred embodiment, the four seven-segment displays of second display 164 are driven by processing unit 160 through a hexadecimal to seven-segment decoder/driver. Second display 164 suitably indicates water heater tank temperature (outlet and inlet), indirect water tank temperature, set point temperature, outlet-inlet differential temperature, hysteresis (switching differential), and various error codes.

Control system 10 includes many inherent diagnostic and fault detection routines built into its operating hardware and software. These routines, in conjunction with display unit 162 assist service personnel in quickly pinpointing the source of a problem which may occur within the appliance.

It should be appreciated that other suitable display types may be used, such as a single display which incorporates the display functions of both the first and second displays, or a touch-screen display unit.

In a preferred embodiment, input unit 166 includes selectors, which are used for such functions as selecting the desired set/display mode ("SELECT"), setting a parameter of interest ("ADJUST"), and saving an entry to memory ("ENTER"). It should be appreciated that input unit 166 may take such suitable forms as individual pushbuttons, a rotary encoder with integral push button, or membrane keypad. Input unit 166 may take other forms suitable for inputting data to control system 10, including a touch-screen display, which also incorporates display unit 162.

Communications port 170 preferably takes the form of an RS-232 interface. A remote processing system 180 and/or remote display unit 190 is interfaced with control system 10 via communications port 170. Remote processing system 180 includes a personal computer (PC) 182 having a modem 184. Remote processing system 180 can be used to remotely perform such functions as control and set temperature set-points and switching differential, and view diagnostics and status information for the appliance.

Remote display unit 190 allows for remote monitoring of control system 10 operations. In this regard, control system 10 is designed to accept an additional I/O control unit as a remote display unit. In a preferred embodiment, an 8-conductor cable is connected between I/O control unit 150 in the appliance, and the remote display unit 190. A shorting jumper is suitably used to configure I/O control unit 150 for either a local or remote display mode.

I/O control unit 150 provides a user friendly interface to control system 10. In this regard, I/O control unit 150 allows the user to control appliance functions and view overall operating status of the appliance. If an error condition occurs, display unit 162 may scroll a diagnostic messages across display unit 162. Under normal operating conditions, display unit 162 may continuously illustrate the water temperature sensed at first temperature probe 52. Input unit 166 allows the user to program and view the desired water temperature set point. In a preferred embodiment of the present invention I/O control unit 150 is connected to the main control unit 20 through a 6-conductor cable assembly with modular plug terminations. In addition, as mentioned above, an 8-conductor modular jack on I/O control unit 150 allows for connection to a remote display 190. Alternatively, the 8-conductor can be used for serial communications (i.e., RS232).

When power is initially applied to control system 10, I/O control unit 150 will initially run through a self-diagnostic test, and then display the outlet temperature sensed by probe 52. In accordance with a preferred embodiment of the present invention, a specific setting or temperature is displayed by activating the SELECT pushbutton of input unit 166 until an appropriate LED is illuminated. Afterwards, I/O control unit 150 automatically reverts to displaying the outlet temperature. Pressing the ENTER pushbutton holds the display unit in the indicated mode until the SELECT pushbutton is pressed.

Figure 9:
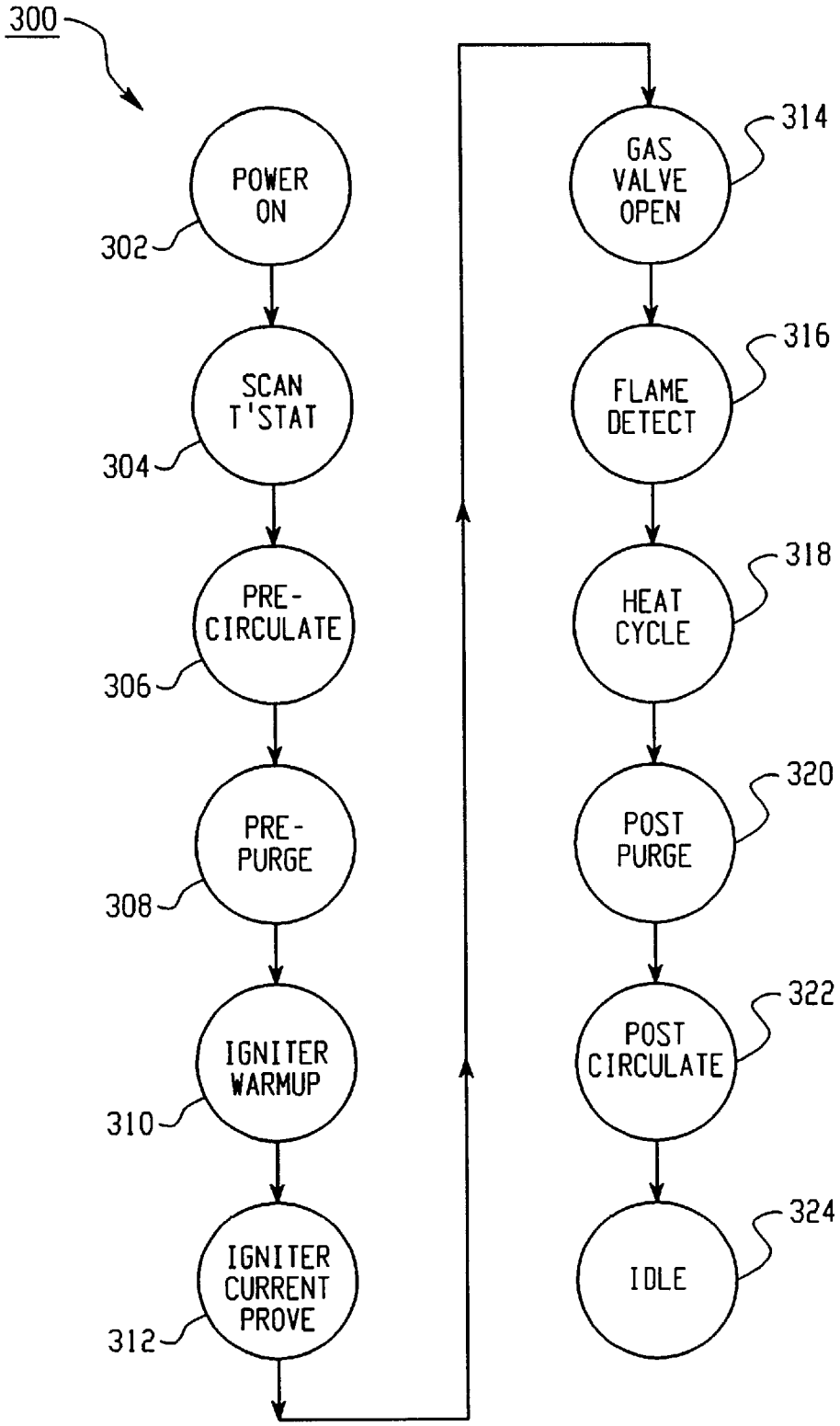
FIG. 9 is a flow diagram showing the basic sequence of operations of the appliance control system.

The basic operating procedure for control system 10 will now be described with reference to FIG. 9, which shows flow diagram 300. At step 302, power is applied to control system 10. As a result, I/O control unit 150 will initially run through a self-diagnostic routine, and then go into its standard operating mode, displaying the temperature sensed by first temperature probe 52 at the outlet. If control system 10 determines that the actual water temperature at the outlet is below the programmed set point temperature less a programmable "switching differential", then a call for heat is activated (step 304). It should be understood that the "switching differential" is suitably programmed to a value typically in the range of 5 to 50 degrees F. The "switching differential" or "hysteresis" facilitates proper operation and maximize appliance performance. In this regard, a call for heat becomes active when the water temperature measured at the outlet (first temperature sensing probe 52) drops to the set point temperature value minus the switching differential value.

Next, control system 10 performs selected system diagnostic checks. This includes confirming the proper state of the ECO/High Limit device, flow switch, air pressure, and gas pressure. If all checks are successfully passed, circulating pump 70 is energized for the pre-circulate cycle (step 306). During pre-circulate, the water inside water heater tank 4 is circulated. Next, combustion blower 60 is energized for the pre-purge cycle (step 308). During pre-purge any gas remaining in burner chamber 6 is blown out (i.e., evacuated). When the pre-purge cycle is complete, power is applied to hot surface igniter 100 for the igniter warm-up period (step 310), e.g., 15–20 seconds. It should be noted that circulation pump 70 and combustion blower 60 will continue running during this step. Control system 10 will verify igniter current using igniter current proving circuit 90, as described above (step 312). At the conclusion of the igniter warm-up period, gas valve(s) 130A, 130B are opened, allowing gas to enter burner chamber 6 (step 314). Thereafter, igniter 100 remains on for a short predetermined time period, then is turned off. Afterwards, control system 10 monitors flame sense probe 112 to confirm that a flame is present (step 316). If a flame is not verified within this time period, gas valve(s) 130A, 130B are immediately closed, and controller operations return to step 304. However, if control system 10 has been configured for one ignition trial, control system 10 will enter a lockout state at this point of operation. If a flame is confirmed, control system 10 enters the heating cycle (step 318) where it will continue heating until the set point temperature is reached. At that point, gas valve(s) 130A, 130B are closed and control system 10 simultaneously enters post-purge (step 320) and post-circulate cycles (step 322).

Combustion blower 60 runs for the duration of the post-purge cycle to purge the system of all combustion gases. When the post-purge cycle is complete, the combustion blower is de-energized. Circulating pump 70 continues with the post-circulate cycle for a predetermined additional amount of time. After the post-circulate cycle is completed control system 10 enters an idle state (step 324) while continuing to monitor temperature and the state of other system devices. If the temperature drops below the set point value minus the switching differential, control system 10 will automatically return to step 304 and repeat the entire operating cycle. During this idle state, if control system 10 detects an improper operating state for system devices such as the ECO switch, air pressure switch, gas pressure switch, improper condition of relays, etc., the appropriate LED(s) on display unit 162 will illuminate indicating the nature of the fault.

It should be understood that control system 10 may be configured to offer various numbers of trials for ignition. Where control system 10 has been configured for one ignition trial, if the gas should fail to ignite at the burner during the first trial for ignition, control system 10 will automatically enter a lockout state and an Ignition Fail LED will illuminate on display unit 162. The lockout state is manually reset by pressing any of the buttons on input unit 166. Where control system 10 has been configured for three ignition trials, if the gas should fail to ignite at the burner during the first trial for ignition, control system 10 will perform two (2) more ignition trials prior to entering a lockout state. It should be noted that each subsequent ignition trial will not occur immediately. In this regard, after a failed trial for ignition, control system 10 will remove all power from the gas valve and igniter and return to the pre-purge cycle. Control system 10 will cycle through a normal operation, and again check for flame at the appropriate time. If ignition is sensed during any one of these trials, normal operation will resume. If flame is not sensed after the third ignition trial, control system 10 will automatically enter a lockout state and an Ignition Fail LED on display unit 162 will illuminate. The lockout state is manually reset by pressing any of the buttons on input unit 166.

Under normal operating conditions, should a failure occur, control system 10 will automatically enter a lockout state and an appropriate LED on display unit 162 will illuminate.

I/O control unit 150 allows the user to make adjustments to many of the appliance's control features, including the appliance temperature set point value, the appliance switching differential value, appliance post-circulate time, appliance circulating pump mode, and water temperature in an indirect tank.

To facilitate proper operation and maximize appliance performance, control system 10 has a programmable operating switching differential or "hysteresis" about the set point temperature. Accordingly, a call for heat will become active when the water temperature measured at the outlet (first temperature sensing probe 52) drops to the set point value minus the switching differential value. The burner will remain on until the water temperature measured at the outlet reaches the set point value. The switching differential value is fully programmable from 5° F. to 50° F. using input unit 166.

Main control unit 20 counts the number of cycles the appliance has operated. In the Main control unit 20, a cycle is counted every time a gas valve is energized.

As mentioned above, control system 10 is adaptable to control the water temperature of an indirect water tank 8 (i.e., remote storage tank). This capability is implemented by installing optional third temperature probe 56 in indirect water tank 8. Sensor for third temperature probe 56 preferably takes the form of a thermistor, as described above. Control system 10 senses the presence of third temperature probe 56 and automatically begins controlling indirect water tank 8 in combination with water heater 2. If third temperature probe 56 is removed, control system 10 will immediately return to controlling only water heater 2. In a preferred embodiment of the present invention, the standard programmable temperature range for the indirect water tank is approximately 110° F. to 190° F. and the "switching differential" for the indirect water tank is fixed at 5° F. However, as indicated above, the "switching differential" is programmable.

The set point temperature for indirect water tank 8 can be set using input unit 166. The temperature differential between the set point temperature for water heater 2 ("set point WH") and the setpoint temperature for indirect water tank 8 ("setpoint IWT") can be either fixed or adaptive.

With a fixed temperature differential, modifications to setpoint IWT will automatically cause a corresponding modification of setpoint WH. As a result, the temperature differential between setpoint A and setpoint IWT will remain constant, within the temperature limits of the appliance. For instance, if the setpoint IWT is set for 150° F., and setpoint WH is set for 190° F., when setpoint IWT is adjusted up to 160° F., setpoint WH will automatically adjust to 200° F. As a result, the 40° F. differential between setpoint A and setpoint IWT is maintained. Accordingly, the foregoing arrangement allows for the setpoint temperatures for both indirect water tank 8 and water heater 2 to be set at a single physical location.

With an adaptive temperature differential the difference between setpoint WH and setpoint IWT will vary depending upon various conditions. For instance, main processing unit 30 can evaluate past results (e.g., overshoot and undershoot) to predict future conditions with regard to temperatures in water heater 2 and indirect water tank 8. As a result, modifications can be made to the temperature differential, for example, to minimize the number of times the burner in burner chamber 6 must be fired.

In an alternative embodiment of the present invention, an optional fourth temperature probe 57 is arranged in indirect water tank 8. Fourth temperature probe 57 is preferably a thermistor, as described above. By having two temperature probes (each at different locations) in indirect water tank 57 (e.g., one at the top and one at the bottom of the tank), main processing unit 30 can determine the ratio of the two sensed temperatures in indirect water tank 8. As a result, main processing unit 30 can intelligently evaluate stratification of the water temperature in the indirect water tank. In addition, this ratio can be used to provide an "anticipation" feature, wherein control system 20 can take an action in anticipation of future temperature conditions in indirect water tank 8. For example, when a ratio is in a particular range, main processing unit 30 could fire up the main burner in water heater 2, start the circulation pump in water heater 2, or start a circulation pump in tank 8. Moreover, the ratio of the temperatures sensed by temperature probes 52 and 54 in water heater tank 4 could also be determined, and considered in evaluating possible operating conditions. It should be noted that fourth temperature probe 57 may also server merely as a "backup" probe to temperature probe 56.

Main processing unit 30 can also intelligently evaluate the temperature differential between the two temperature probes in tank 8 and between the two temperature probes in water heater tank 4. This information can be used to make an informed decision regarding future operating conditions.

It should be appreciated that main processing unit 30 can be programmed to operate in a constant temperature mode or an economy mode. In a constant temperature mode, main processing unit 30 keeps the temperature of the water in indirect water tank 8 very close to the setpoint temperature of the appliance. In the economy mode main processing unit 30 minimizes energy consumption and wear of system components. In this regard, the number of times the burner in water heater 2 is turned ON is minimized. For instance, the circulation pump may be activated to distribute residual heat, in lieu of turning the burner ON.

In the event that either temperature probe 56 or temperature probe 57 malfunction, main processing unit 30 can identify which probe is malfunctioning and provide the operator with information on display unit 162 regarding the malfunctioning probe. Moreover, main processing unit 30 can determine if the malfunctioning probe is shorted or open.

In yet another embodiment of the present invention, main processing unit 30 can provide an analog output to control a variable-speed pump, which in turn controls the flow of heat into indirect water tank 8. Accordingly, main processing unit 30 can variably control the temperature in indirect water tank 8.

It should be appreciated that the temperature probes in indirect water tank 8 can be eliminated completely, and replaced by a program run by main processing unit 30, which makes decisions based upon historical results, and the temperature conditions sensed by probes 54 and 58 in water heater tank 4.

The invention has been described with reference to a preferred embodiment. Obviously, modifications and alterations will occur to others upon a reading and understanding of this specification. For instance, the present invention has been described with particular reference to a gas appliance. It is contemplated that the present invention may be suitably modified to control an electric appliance. Moreover, the present invention may be suitably modified to provide an adaptive control for modulating operation of the appliance. For example, output signals from the main processing unit are sent to a "variable-speed" combustion blower, "variable-speed" circulation pump, and/or variable gas valve(s). These output signals will have a range of values, rather than just an ON and OFF value. The relay switches (which provide either an ON signal or an OFF signal) are replaced with varying analog output signals. Moreover, the main processing unit receives inputs from pressure and/or flow transducers, which provide feedback information from the combustion blower, pump and/or gas valve. This feedback information is used by the main processing unit to modulate the analog output signals. It is intended that all such modifications and alterations be included insofar as they come within the scope of the appended claims or the equivalents thereof.

Having thus described the invention, it is now claimed:

1. An appliance controller for controlling an associated gas appliance having a gas-fired burner means, the appliance controller comprising:

processing means for controlling operation of the appliance controller; and current detection means for detecting an igniter current associated with a hot surface igniter for igniting gas in the burner means, wherein said current detection means communicates a first value indicative of the igniter current to said processing means for evaluation thereby.

2. An appliance controller according to claim 1, wherein said processing means includes memory means for storing each said first value communicated by said current detection means, said processing means comparing a present first value to one or more previously stored first values to evaluate degradation of said hot surface igniter.

3. An appliance controller according to claim 1, wherein said processing means determines a time period for activating said igniter current to heat said hot surface igniter to a temperature sufficient to ignite said gas.

4. An appliance controller according to claim 1, wherein said processing means determines whether an igniter current is present, said processing means prohibiting release of gas to said burner means if the igniter current is not present.

5. An appliance controller according to claim 1, wherein said first value communicated by said current detection means to said processing means is a voltage.

6. An appliance controller according to claim 5, wherein said appliance controller further comprises an analog-to-digital converter (ADC) for digitizing said voltage.

7. An appliance controller according to claim 1, wherein said current detection means includes:

current input means for receiving the igniter current associated with said hot surface igniter; and conversion means for converting the igniter current to a voltage indicative of the igniter current, wherein said voltage is said first value.

8. An appliance controller according to claim 7, wherein said processing means digitizes said first value, and compares the digitized first value to a predetermined value.

9. An appliance controller according to claim 1, wherein said appliance controller further comprises:

flame detection means for detecting the presence of a flame associated with the burner means, by obtaining a second value indicative of a current associated with the flame, wherein said flame detection means communicates the second value to said processing means for evaluation thereby; and switching means for selectively connecting said hot surface igniter with said current detection means and the flame detection means, to respectively provide a current thereto, said hot surface igniter acting as a flame probe when connected with said flame detection means.

10. An appliance controller according to claim 1, wherein said processing means controls operation of said burner means by transmitting signals for opening and closing at least one valve means controlling the release of gas into said burner means, said processing means communicating with said at least one valve means through interface means including shift register means capacitively coupled to switch means for opening and closing said at least one valve means.

11. An appliance controller for controlling an associated gas appliance having a gas-fired burner means, the appliance controller comprising:

processing means for controlling operation of the appliance controller; and flame detection means for detecting the presence of a flame associated with the burner means, by obtaining a first value indicative of a current associated with the flame, wherein said flame detection means communicates the first value to said processing means for evaluation thereby.

12. An appliance controller according to claim 11, wherein said processing means determines a flame quality based on said first value.

13. An appliance controller according to claim 11, wherein said processing means includes memory means for storing each said first value communicated by said current detection means, said processing means comparing a present first value to one or more previously stored first values to evaluate degradation of at least one flame probe associated with said flame detection means.

14. An appliance controller according to claim 11, wherein said processing means compares said first value to a predetermined value to evaluate degradation of at least one flame probe associated with said flame detection means.

15. An appliance controller according to claim 11, wherein said processing means closes a gas valve controlling the release of gas into said burner means, when said first value is indicative of an absence of said flame associated with the burner means.

16. An appliance controller according to claim 11, wherein said flame detection means includes:

input means for sensing ions generated by said flame, said input means generating a flame current indicative of the presence of said flame;

conversion means for converting the flame current to a voltage proportional to the flame current, wherein said voltage is said first value.

17. An appliance controller according to claim 11, wherein said processing means closes a gas valve associated with said burner means when said first value is indicative of an absence of flame in said burner means.

18. An appliance controller according to claim 11, wherein said first value communicated by said flame detection means to said processing means is a voltage.

19. An appliance controller according to claim 18, wherein said appliance controller further comprises an analog-to-digital converter (ADC) for digitizing said voltage.

20. An appliance controller for controlling an associated gas appliance having a gas-fired burner means, the appliance controller comprising:

processing means for controlling operation of the appliance controller;

first monitoring means for determining an igniter current associated with a hot surface igniter for igniting gas in the burner means, wherein said first monitoring means communicates a first value indicative of the igniter current to said processing means for evaluation thereby; and second monitoring means for detecting the presence of a flame associated with the burner means, by obtaining a second value indicative of a current associated with the flame, wherein said second monitoring means communicates the second value to said processing means for evaluation thereby.

21. An appliance controller according to claim 20, wherein said processing means includes memory means for storing said first and second values.

22. An appliance controller according to claim 21, wherein said processing means further includes means for respectively comparing present first and second values to previously stored first and second values.

23. An appliance controller according to claim 20, wherein said processing means includes means for respectively comparing said first and second values to first and second predetermined values.

24. An appliance controller according to claim 20, wherein said associated gas appliance includes a water tank, said appliance controller further comprising:

temperature sensing means for sensing the temperature of water associated with the water tank and providing temperature data to said processing means.

25. An appliance controller according to claim 24, wherein said appliance controller further comprises:

third monitoring means for detecting a temperature in the water tank that exceeds a predetermined high limit temperature, wherein said third monitoring means operates independently of said processing means.

26. An appliance controller according to claim 24, wherein said appliance controller further comprises:

high limit circuit means for detecting a temperature in the water tank that exceeds a predetermined high limit temperature.

27. An appliance controller according to claim 26, wherein said high limit circuit means includes a third temperature sensing device at the outlet of said water tank.

28. An appliance controller according to claim 26, wherein said high limit circuit means includes:

a thermistor located at the outlet of said water tank, and comparator means for comparing the temperature sensed by the thermistor to a predetermined high limit temperature.

29. An appliance controller according to claim 20, wherein said gas-fired burner heats a fluid, said appliance controller further comprising:

a temperature sensing device for measuring the temperature of the fluid after heating by said burner means, said temperature sensing device providing first temperature data to said processing means.

30. An appliance controller according to claim 29, wherein said fluid is located in a tank during heating by said burner means.

31. An appliance controller according to claim 20, wherein said controller further comprises:

an input unit for inputting program data to said processing means; and an output display unit for displaying controller data.

32. An appliance controller according to claim 20, wherein said appliance controller further comprises an ignition means for igniting gas associated with said burner means.

33. An appliance controller according to claim 32, wherein said ignition means includes one of: a standing pilot ignition, a spark ignition, and a hot surface ignition.

34. An appliance controller for controlling an associated gas appliance having a gas-fired burner means, the appliance controller comprising:

a safety limit string means including a plurality of switch means connected in series, for closing a gas valve in the event of a malfunction condition, said safety limit string operating independently of said processing means; and processing means for controlling operation of the appliance controller, wherein said processing means monitors the status of switching means connected in and outside the safety limit string means, for diagnosing a malfunction in accordance with the status of said switching means in the safety limit string means and the status of said switching means outside said limit string means.

35. An appliance controller according to claim 34, wherein said processing means takes adaptive action in response to a malfunction condition.

36. An appliance controller according to claim 34, wherein said limit string is configurable by selectively connecting switching means with said limit string.

37. An appliance controller for controlling an associated gas appliance having a gas-fired burner means, a water tank having at least one inlet and at least one outlet, and an indirect water tank for storing water from said water tank, the appliance controller comprising:

a first temperature sensing device located at one of said at least one outlets of said water tank;

a second temperature sensing device located at one of said at least one inlets of said water tank;

a third temperature sensing device for sensing the temperature of the water in said indirect water tank at a first location, said processing means responsive to said third temperature sensing device;

a fourth temperature sensing device for sensing the temperature of water in said indirect water tank at a second location; and processing means for controlling operation of the appliance controller, said processing means responsive to said fourth temperature sensing device to determine a ratio of temperatures sensed by said third and fourth temperature sensing devices.

38. An appliance controller according to claim 37, wherein said processing means modifies a first setpoint temperature for said water tank in accordance with a second setpoint temperature established for said indirect water tank.

39. An appliance controller according to claim 37, wherein said first temperature sensing device and said third temperature sensing device are located in the same housing.

40. An appliance controller according to claim 37, wherein processing means includes means for programming a switching differential value, wherein said processing means activates said burner means when the water temperature measured by said first temperature sensing device has decreased to a setpoint temperature minus the switching differential value.

41. An appliance controller according to claim 40, wherein said processing means deactivates said burner means when the water temperature measured by said first temperature sensing device has increased to the setpoint temperature.

42. An appliance controller according to claim 40, wherein said switching differential value is programmable in a range of approximately 5 degrees F. to 50 degrees F.

* * * * *